US008441415B2

(12) United States Patent
Weitbruch et al.

(10) Patent No.: US 8,441,415 B2
(45) Date of Patent: May 14, 2013

(54) METHOD AND DEVICE FOR REDUCING LINE LOAD EFFECT

(75) Inventors: Sébastien Weitbruch, Kappel (DE); Cédric Thebault, Villingen-Schwenningen (DE); Carlos Correa, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1273 days.

(21) Appl. No.: 10/583,533

(22) PCT Filed: Dec. 14, 2004

(86) PCT No.: PCT/EP2004/053440

§ 371 (c)(1),
(2), (4) Date: May 7, 2007

(87) PCT Pub. No.: WO2005/059879

PCT Pub. Date: Jun. 30, 2005

(65) Prior Publication Data

US 2007/0273614 A1 Nov. 29, 2007

(30) Foreign Application Priority Data

Dec. 17, 2003 (EP) ..... 03293194
Dec. 17, 2003 (EP) ..... 03293195

(51) Int. Cl.
*G09G 3/28* (2006.01)

(52) U.S. Cl.
USPC ..... 345/60; 345/63; 345/691

(58) Field of Classification Search ..... None
See application file for complete search history.

(56) References Cited

U.S. PATENT DOCUMENTS

| | | | | |
|---|---|---|---|---|
| 5,343,215 | A | 8/1994 | Tanaka | |
| 6,100,859 | A * | 8/2000 | Kuriyama et al. | 345/60 |
| 6,104,362 | A | 8/2000 | Kuriyama et al. | |
| 6,559,816 | B1 * | 5/2003 | Koo et al. | 345/60 |
| 7,091,934 | B2 * | 8/2006 | Kim et al. | 345/60 |
| 2003/0173903 | A1 * | 9/2003 | Takeuchi et al. | 315/169.2 |
| 2005/0104811 | A1 * | 5/2005 | Lee et al. | 345/60 |

FOREIGN PATENT DOCUMENTS

| | | |
|---|---|---|
| EP | 0653740 | 5/1995 |
| EP | 0841652 | 5/1998 |
| EP | 1345199 | 9/2003 |
| EP | 1959418 | 10/2008 |

(Continued)

OTHER PUBLICATIONS

Search Report Dated Apr. 26, 2005.

*Primary Examiner* — Amare Mengistu
*Assistant Examiner* — Antonio Xavier
(74) *Attorney, Agent, or Firm* — Robert D. Shedd; Vincent E. Duffy; James McKenzie

(57) ABSTRACT

The present invention relates to a method for processing data of a picture to be displayed on a display panel with persistent luminous elements in order to reduce load effect in said display means. The method comprises the following steps:

Figure 1:
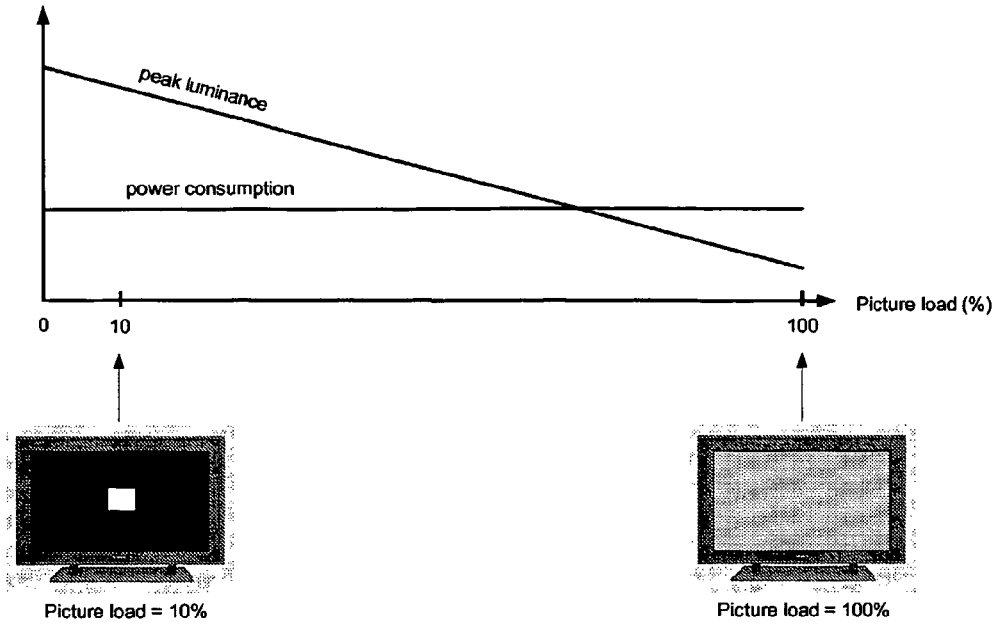

computing, for each subfield, the amount of activated luminous elements in each line of luminous elements of the display panel, called line load, calculating, for each subfield, the maximal difference of line loads of two consecutive lines of the display panel, and selecting, for each subfield, a sustain frequency in accordance with its maximal load difference in order to reduce line load effect.

13 Claims, 13 Drawing Sheets

FOREIGN PATENT DOCUMENTS

| | | |
|---|---|---|
| JP | 03182792 | 8/1991 |
| JP | 08160912 | 6/1996 |
| JP | 09034403 | 7/1997 |
| JP | 09068945 | 11/1997 |
| JP | 2000172223 | 6/2000 |
| JP | 2000172226 | 6/2000 |
| JP | 2001083929 | 3/2001 |
| JP | 2005128133 | 5/2005 |
| JP | 2005062337 | 10/2005 |

* cited by examiner

Low sustain frequency

High sustain frequency

17

| Sustain pulses number | Load (%) | | | | | | | | | | |
|---|---|---|---|---|---|---|---|---|---|---|---|
| | 0 | 1.5 | 3 | | 17 | | 30 | | 70 | | 100 |
| 1 | 0 | 0 | 0 | | 0 | | 0 | | 0 | | 0 |
| 2 | 1 | 1 | 1 | | 1 | | 0 | | 0 | | 0 |
| 3 | 1 | 1 | 1 | | 1 | | 1 | | 0 | | 0 |
| 107 | 36 | 36 | 36 | | 32 | | 26 | | 8 | | 0 |
| 339 | 114 | 114 | 114 | | 102 | | 84 | | 26 | | 0 |

Correction values

FIG.18

METHOD AND DEVICE FOR REDUCING LINE LOAD EFFECT

This application claims the benefit, under 35 U.S.C. §365 of International Application PCT/EP2004/053440, filed Dec. 14, 2004, which was published in accordance with PCT Article 21(2) on Jun. 30, 2005 in English and which claims the benefit of European patent application No. 03293194.1 filed Dec. 17, 2003 and European patent application No. 03293195.8 filed Dec. 17, 2003.

The present invention relates to a method for processing data of a picture to be displayed on a display panel with persistent luminous elements in order to reduce load effect in said display means.

BACKGROUND

High contrast is an essential factor for evaluating the picture quality of every display technologies. From this perspective, a high peak-white luminance is always required to achieve a good contrast ratio and, as a result, a good picture performance even with ambient light conditions. Otherwise, the success of a new display technology requires also a well-balanced power consumption. For every kind of active display, more peak luminance corresponds also to a higher power that flows in the electronic of the display. Therefore, if no specific management is done, the enhancement of the peak luminance for a given electronic efficacy will lead to an increase of the power consumption. So, it is common to use a power management concept to stabilize the power consumption of the display. The main idea behind every kind of power management concept associated with peak white enhancement is based on the variation of the peak luminance depending on the picture content in order to stabilize the power consumption to a specified value as illustrated on FIG. 1. In this figure, the peak luminance decreases as the picture load increases. The power consumption is kept constant.

The concept described on FIG. 1 enables to avoid any overloading of the power supply as well as a maximum contrast for a given picture. Such a concept suits very well to the human visual system, which is dazzled in case of full white picture (picture load=100%) whereas it is really sensitive to dynamic in case of dark picture (e.g. dark night with a moon). Therefore, in order to increase the impression of high contrast on dark picture, the peak luminance is set to very high values whereas it is reduced in case of energetic pictures (full white).

In the case of analog displays like Cathode Ray Tubes (CRTs), the power management is based on a so called ABM function (Average Beam-current Limiter), which is implemented by analog means, and which decreases video gain as a function of average luminance, usually measured over a RC stage. In the case of a plasma display, the luminance as well as the power consumption is directly linked to the number of sustain pulses (light pulses) per frame. As shown on FIG. 2, the number of sustain pulses for peak white decreases as the picture load, which corresponds to the Average Power Level (APL) of the picture, increases for keeping constant the power consumption.

The computation of the Average Power Level (APL) of a picture P is for example made through the following function:

$$APL(P) = \frac{1}{C \times L} \cdot \sum_{x,y} I(x, y)$$

where I(x,y) represents the luminance of a pixel with coordinates (x,y) in the picture P, C is the number of columns and L is the number of lines of the picture P.

Figure 3:
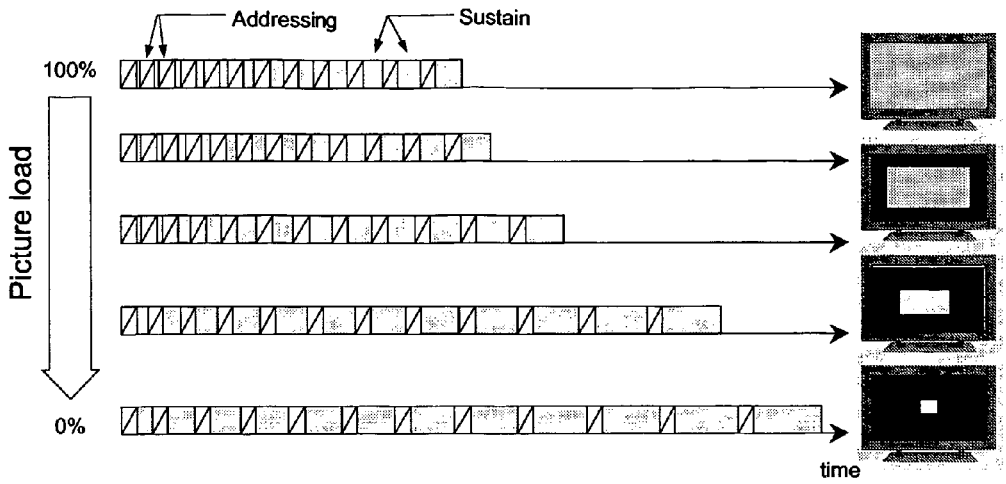

Then, for every possible APL values, a maximal number of sustain pulses is fixed for the peak white pixels for keeping constant the power consumption of the PDP. Since, only an integer number of sustain pulses can be used, there is only a limited number of available APL values. In theory, the number of sustain pulses that can be displayed for the peak white pixels can be very high. Indeed, if the picture load tends to zero, the power consumption tends also to zero, and the maximal number of sustain pulses for a constant power consumption tends to infinite. However, the maximal number of sustain pulses defining the maximal peak white (peak white for a picture load of 0%) is limited by the available time in a frame for the sustaining and by the minimum duration of a sustain pulse. FIG. 3 illustrates the duration and the content of a frame comprising 12 subfields having different weights, each subfield comprising an addressing period for activating the cells of the panel and a sustaining period for illuminating the activated cells of the panel. The duration of the addressing period is identical for each subfield and the duration of the sustaining period is proportional to the weight of the subfield. When the picture load is high, the number of cells consuming energy at a given time is high; so, the duration of the sustaining period should be reduced for keeping constant the average power consumption. That is the reason why the sustaining duration for a frame is higher for a low picture load than for a high picture load.

In addition, in order to achieve a high maximal peak white, the number of subfield is kept to a minimum ensuring an acceptable grayscale portrayal (with few false contour effects), the addressing speed is increased to a maximum keeping an acceptable panel behavior (response fidelity) and the sustain pulse duration is kept to a minimum but having an acceptable efficacy.

Figure 4:
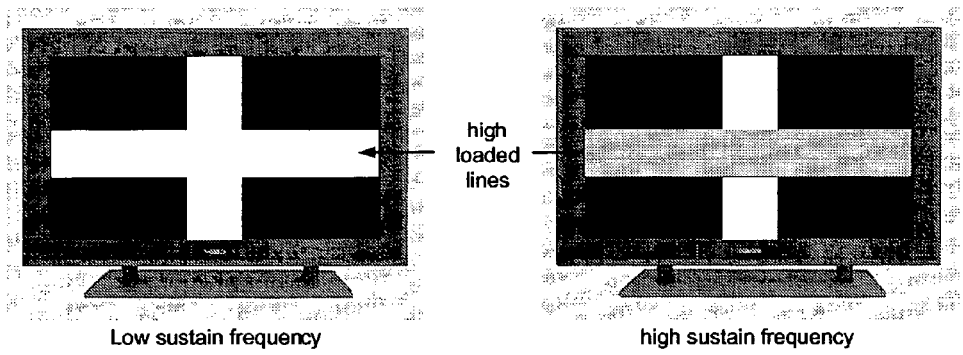

But, at this stage, PDP makers are faced with another problem called load effect explained below. As previously mentioned, a high peak white requires to be able to shorten the duration of a sustain pulse. However, this increase of the sustain frequency has a strong drawback: it increases load effect, especially, when the xenon percentage in the gas of the PDP cells is high. This effect is illustrated by FIG. 4. It represents a white cross on a black background. Losses due to line capacity effect occur and have a strong influence on the panel luminance for a high sustain frequency. The white horizontal lines of the cross are less luminous in a high sustain frequency mode (right part of FIG. 4) than in a low sustain frequency mode (left part). This example shows a line load effect.

The line load effect itself represents a dependence of subfield luminance towards its horizontal distribution. In that case, it does not matter to know the load of the subfield but rather to know the differences of load between two consecutive lines for the same subfield.

When the subfield distribution is "geometrical", e.g. for displaying artificial geometrical patterns, the line load effect is much more critical than for video pictures which suffer mainly from a global load effect.

Generally the load effect is not only limited to the line load but also to a global load of the subfield in a frame. Indeed, if a subfield is globally more used than another one on the whole screen, it will have less luminance per sustain pulse due to this load effect (the losses occur in the screen and in the electronic circuitry).

Figure 5:
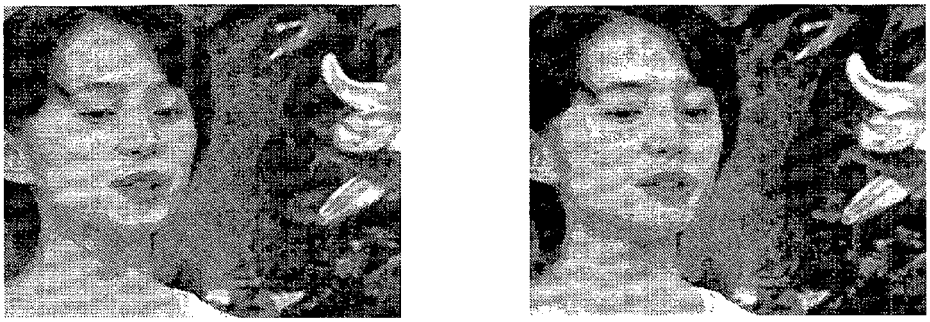

Therefore, on the one hand, a high number of sustain pulses and a high sustain frequency are required for peak white modes and, on the other hand, the panel will lose its homogeneity in case of peak white modes. This can have dramatic effects on natural scene as shown in FIG. 5.

The load effect has an impact on the grayscale portrayal under the form of a kind of solarization effect which looks like a lack of gray levels. In that case, the right picture seems to be coded with fewer bits than the left one. This is due to the fact that some subfields are suddenly less luminous than they should be. In that case, if we consider two video levels that should have similar luminance, and if one of them is using such a subfield, its global luminance will be too low compared to the other video level introducing a disturbing effect.

An object of the method of the invention is to reduce the line load effect that is directly linked to the capacity of a line and not the global load effect that can be compensated by other methods. The method of the invention can be used independently to those methods when a PC mode is selected or in addition to one of them since they are compatible.

Globally, the invention is based on a profile analysis of the line load for each subfield to determine if this subfield is more or less critical to line load effect. If such a subfield is detected, its sustain frequency is reduced to minimize the load effect.

Invention

The invention relates to a method and a device for reducing such a load effect in a display panel with persistent luminous elements.

The invention concerns a method for processing data of a picture to be displayed on a display panel with persistent luminous elements during a frame comprising a plurality of subfields, each subfield comprising an addressing phase during which the luminous elements of the panel are activated or not in accordance with the picture data and a sustain phase during which the activated luminous elements are illuminated by sustain pulses. It comprises the following steps:

- computing, for each subfield, the amount of activated luminous elements in each line of luminous elements of the display panel, called line load,
- calculating, for each subfield, the maximal difference of line loads of two consecutive lines of the display panel, and
- selecting, for each subfield, a sustain frequency in accordance with its maximal load difference in order to reduce line load effect.

Preferably, the calculation of the maximal load difference is only carried out only for lines whose load is greater than a minimal load. This minimal load is for example equal to 10% of the amount of luminous elements in a line of the display panel.

In a particular embodiment, the maximal load difference between two consecutive lines of the display panel is calculated, for each subfield, on the current frame and a plurality of frames preceding said current frame in order to avoid changes in picture luminance when some minor modifications are happening. The maximal load difference used for selecting the sustain frequency is then the mean value of the maximal load differences calculated for said plurality of frames.

Preferably, the number of sustain pulses of each subfield is adjusted in accordance with the number of luminous elements to be activated for displaying the current picture and with the selected sustain frequency for said subfield.

According to the invention, the load effect can also be compensated by adjusting the number of sustain pulses of each subfield.

In that case, the method further comprises the following steps:

- encoding the picture data into subfield data,
- calculating the load of each subfield on the basis of said subfield data, and
- adjusting the number of sustain pulses of the subfields on the basis of their load in order to have a same relation of proportionality between the luminance produced by the persistent luminous elements for the subfields and their weights.

For adjusting the number of sustain pulses of a subfield, the method comprises the following steps:

- providing a first number of sustain pulses for said subfield,
- defining a correction value to be subtracted to said first number of sustain pulses on the basis of the load and the number of sustain pulses of said subfield;
- subtracting said correction value from said first number of sustain pulses in order to have a second number of sustain pulses for said subfield.

In a preferred embodiment, the correction values of the subfields are defined by a look up table with the load and the number of sustain pulses of the subfields as input signals. The correction values stored in the look up table can be achieved in at least two different ways.

In a first embodiment, the corrections values are computed by:

- measuring the luminance produced by a plurality of luminous elements of the display means for all first numbers of sustain pulses comprised between 1 and the first number of sustain pulses M of the highest weight subfield and for a plurality of non-zero loads,
- determining, for each one of said first numbers of sustain pulses and each one of said loads, the luminance attenuation compared with a reference luminance measured for the same number of sustain pulses and the highest one of said loads, and
- computing, for each one of said first numbers of sustain pulses and each one of said loads, the correction value by multiplying the determined luminance attenuation with said first number of sustain pulses.

In a second embodiment, since the attenuation does not much vary with the number of sustain pulses, it is also possible to compute the correction values for a specific number of sustain pulses. In this case, the correction values included in the look up table are achieved by the following steps:

- measuring the luminance produced by a plurality of luminous elements of the display means for a specific first number of sustain pulses and for a plurality of non-zero loads,
- determining, for each one of said loads, the luminance attenuation compared with a reference luminance measured for the highest one of said loads, and
- computing, for each one of said loads and for said specific first number of sustain pulses, the correction value by multiplying the determined luminance attenuation with said specific first number of sustain pulses.

In order to avoid measurement errors, the specific first number of sustain pulses is preferably greater than 20.

In an improved embodiment, the inventive method comprises further a step for rescaling the second numbers of sustain pulses of the plurality of subfields in order to redistribute in each subfield an amount of the subtracted sustain pulses proportionally to its second number of sustain pulses.

In another improved embodiment, before the step of adjusting the number of sustain pulses of each subfield on the basis of its load, said number of sustain pulses is rescaled in order that the average power level needed by the display means for displaying the picture be approximately equal to a fixed target value.

The invention concerns also a device for processing data of a picture to be displayed on a display panel with persistent luminous elements during a frame comprising a plurality of subfields, each subfield comprising an addressing phase during which the luminous elements of the panel are activated or not in accordance with the picture data and a sustain phase during which the activated luminous elements are illuminated by sustain pulses. It comprises:

means for computing, for each subfield, the amount of activated luminous elements in each line of luminous elements of the display panel, called line load, and for calculating, for each subfield, the maximal difference of line loads of two consecutive lines of the display panel, and means for selecting, for each subfield, a sustain frequency in accordance with its maximal load difference in order to reduce line load effect.

The invention concerns also a plasma display panel comprising a plurality of persistent luminous elements organized in rows and columns and said device for reducing load effect.

DRAWINGS

Figure 2:
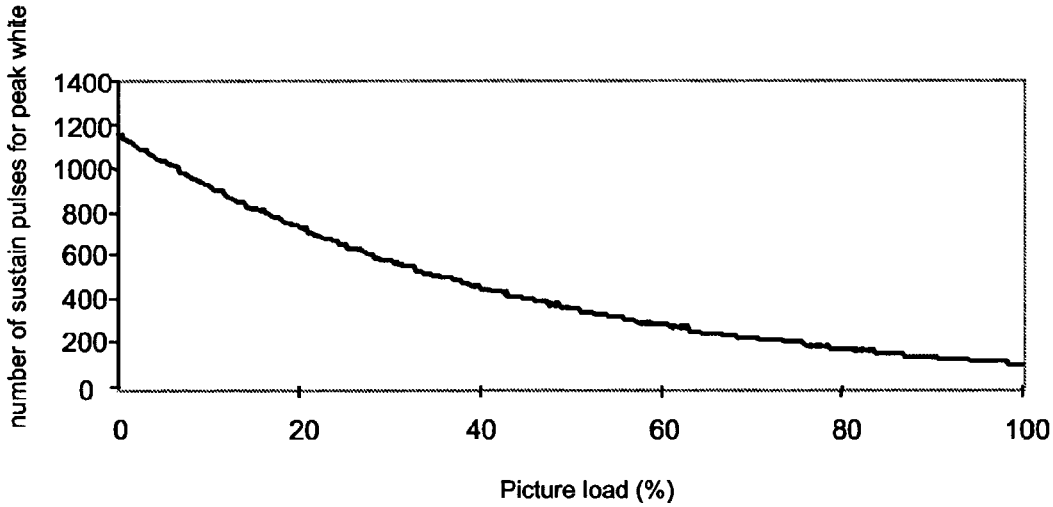
Figure 6:
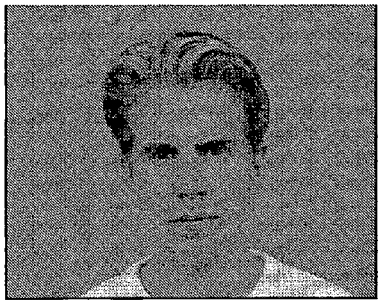
Figure 6:
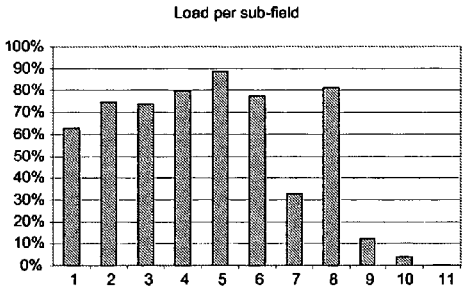
Figure 7:
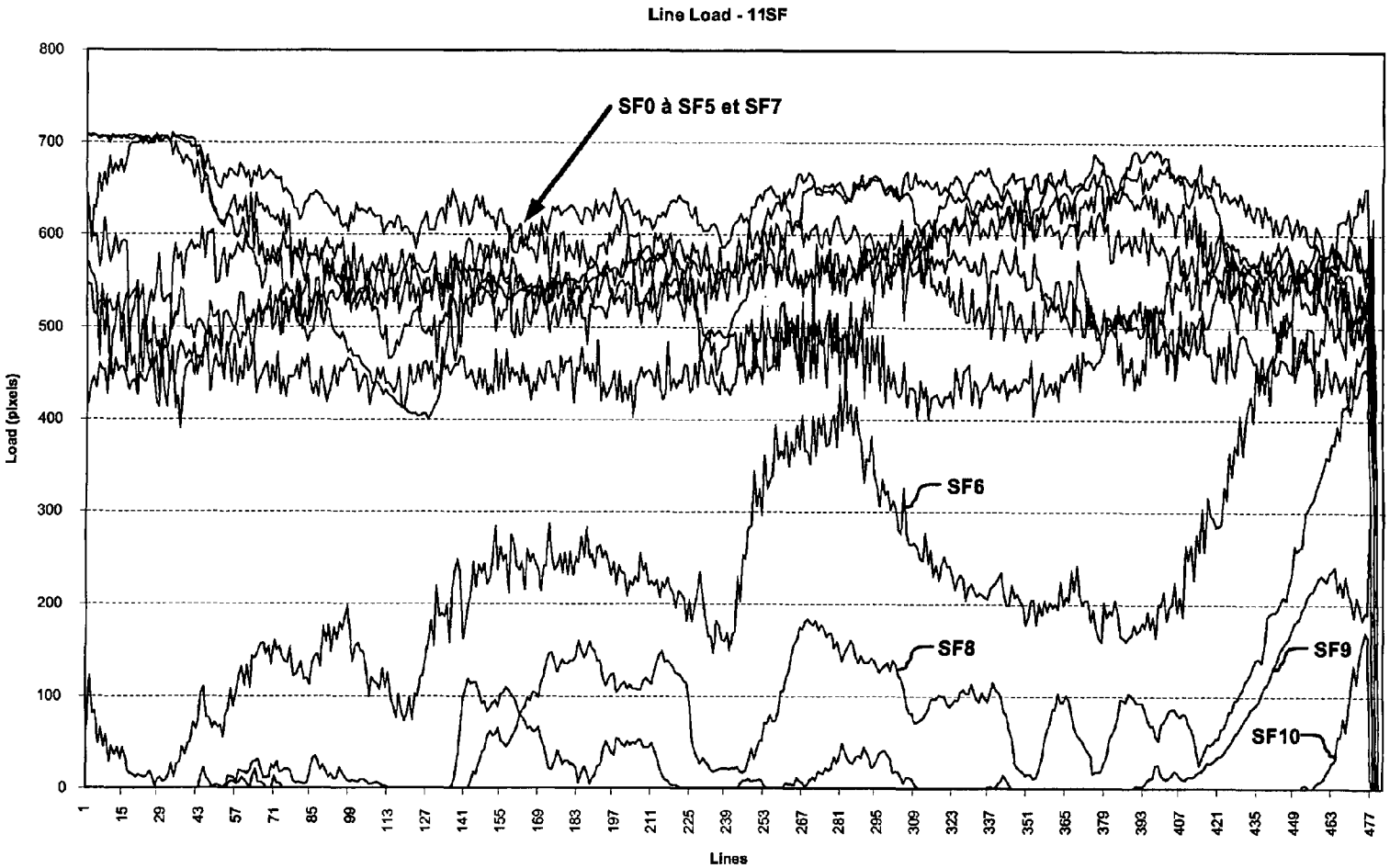
Figure 8:
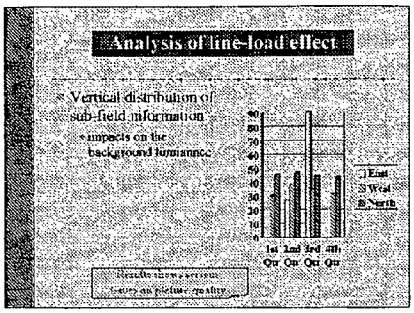
Figure 8:
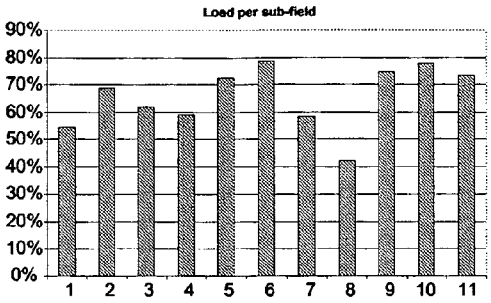
Figure 9:
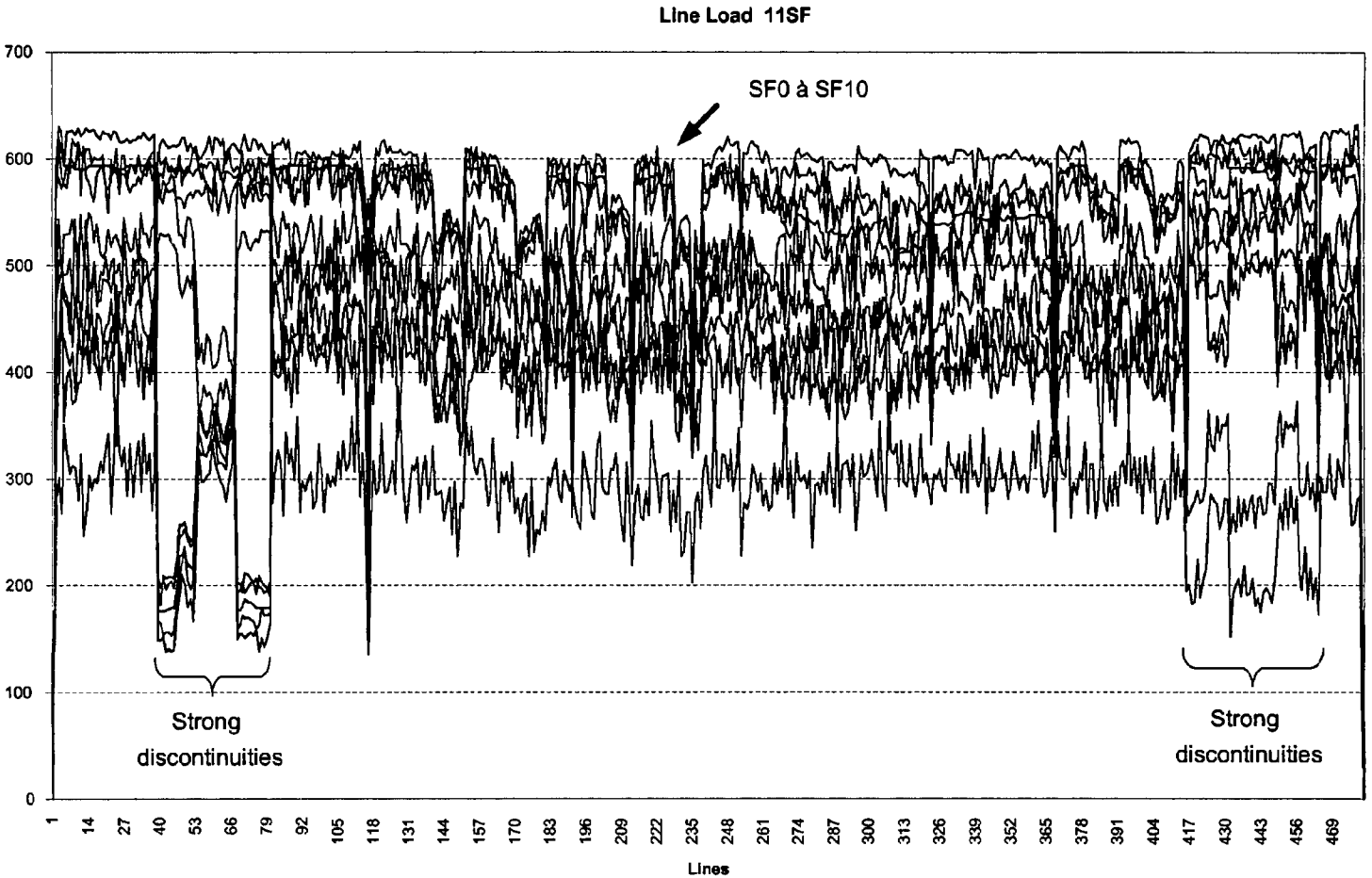
Figure 10:
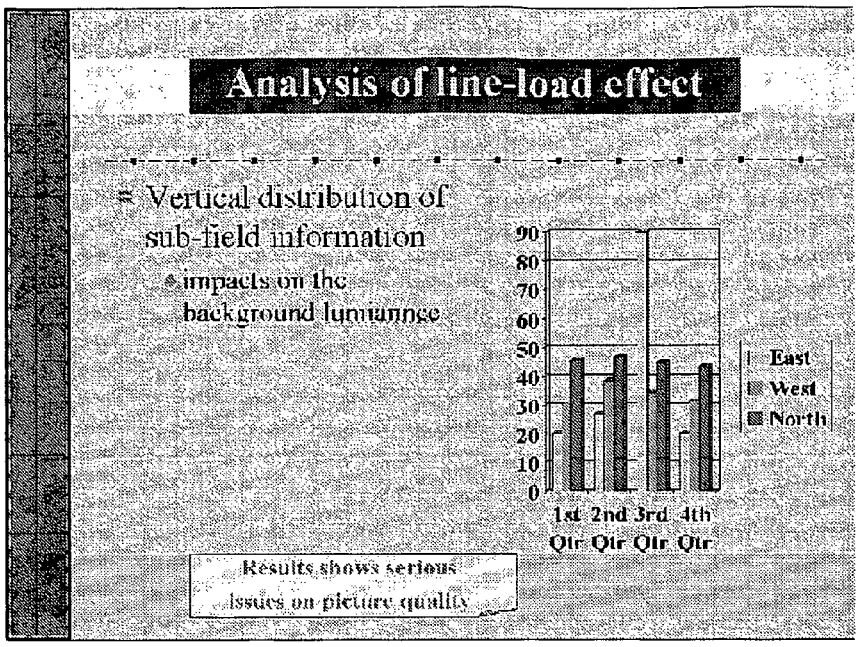
Figure 11:
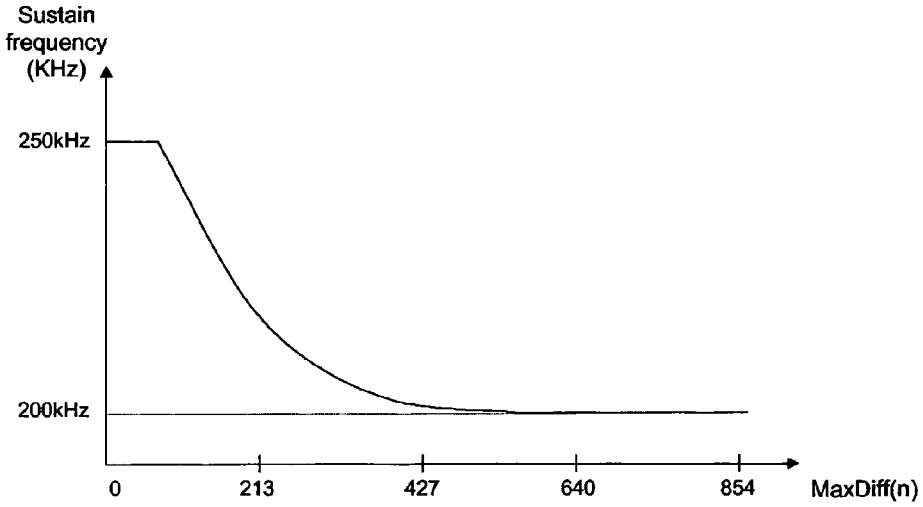
Figure 12:
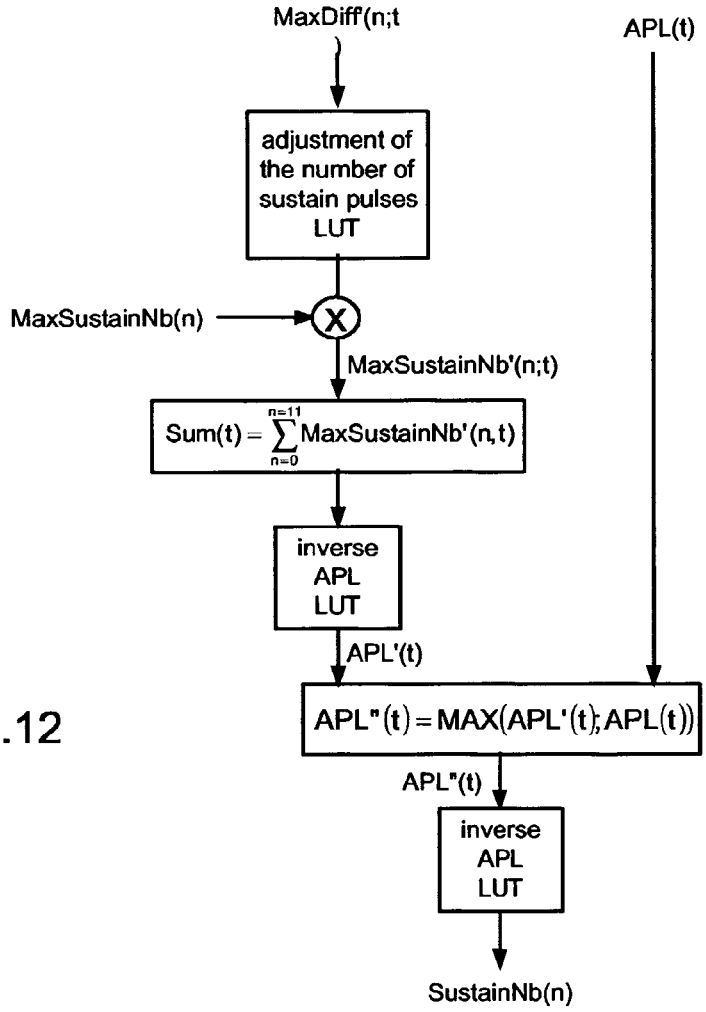
Figure 13:
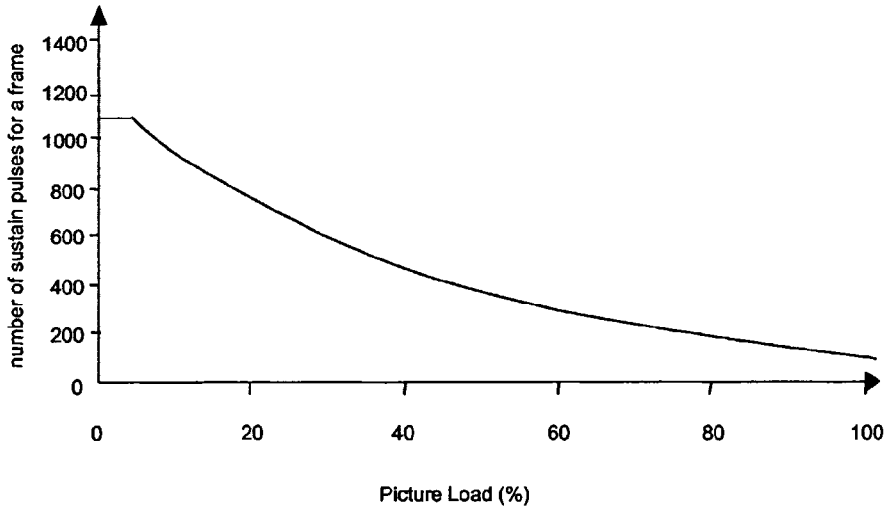
Figure 14:
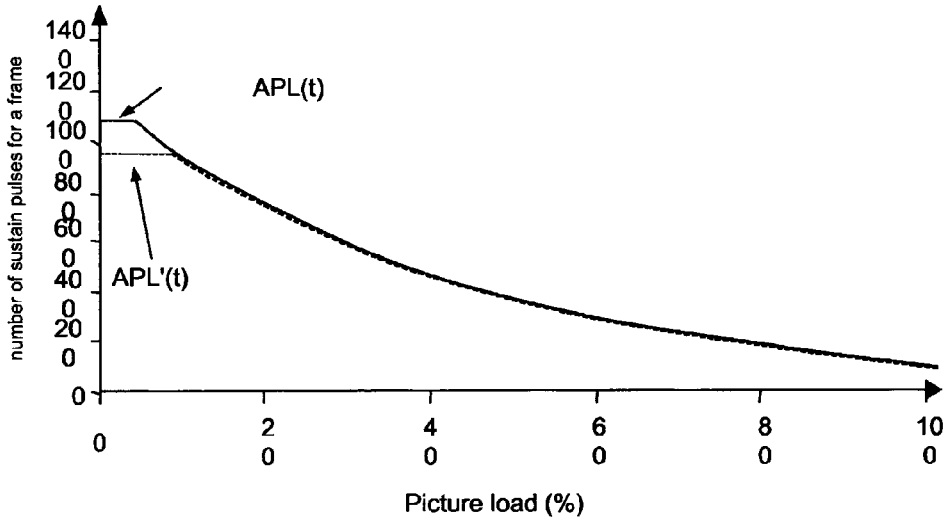
Figure 15:
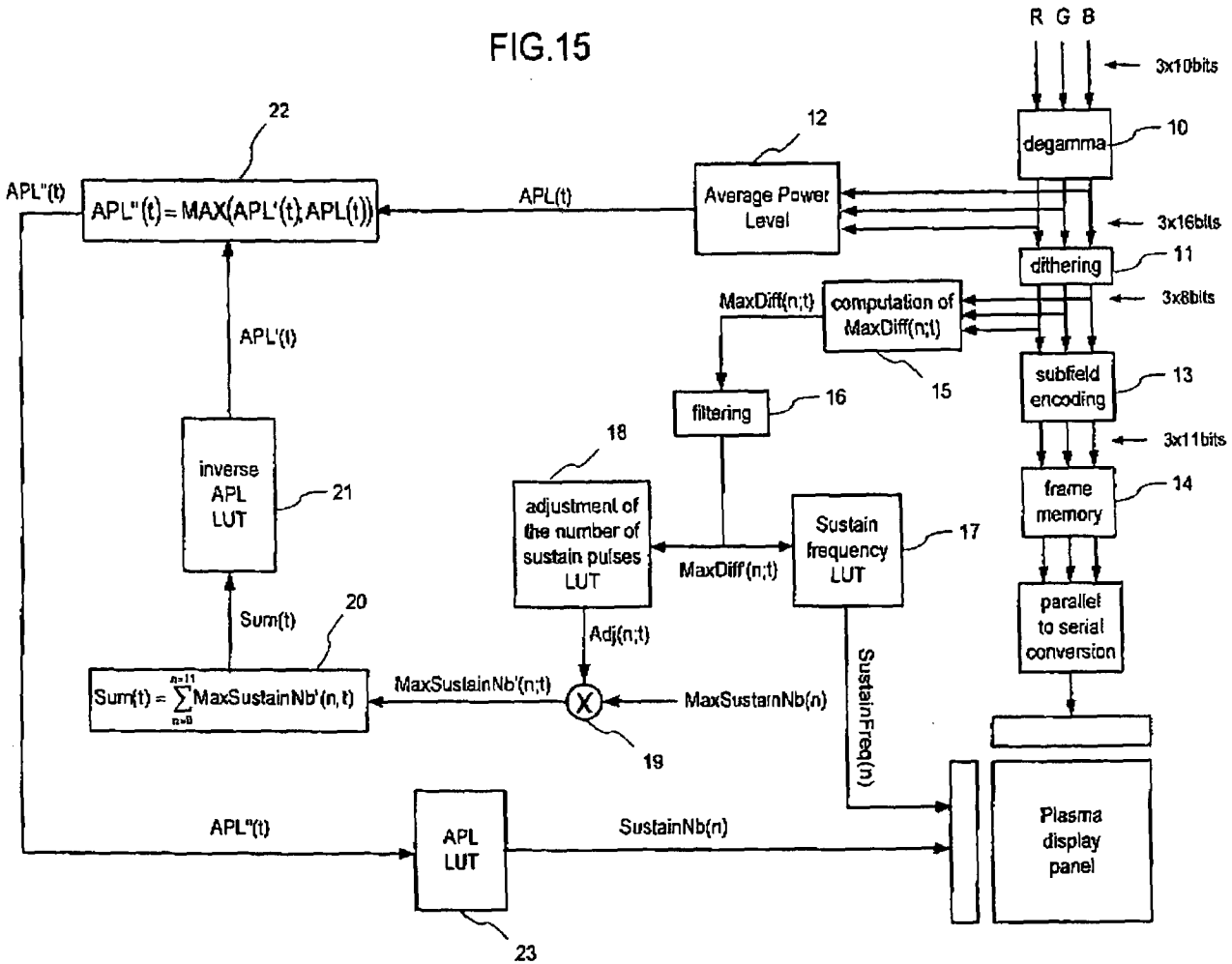
Figure 16:
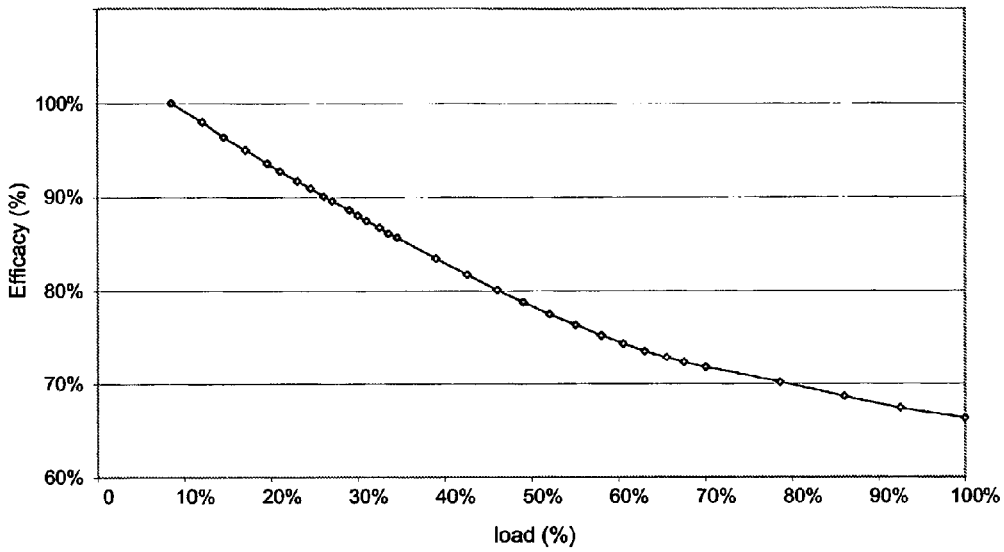
Figure 17:
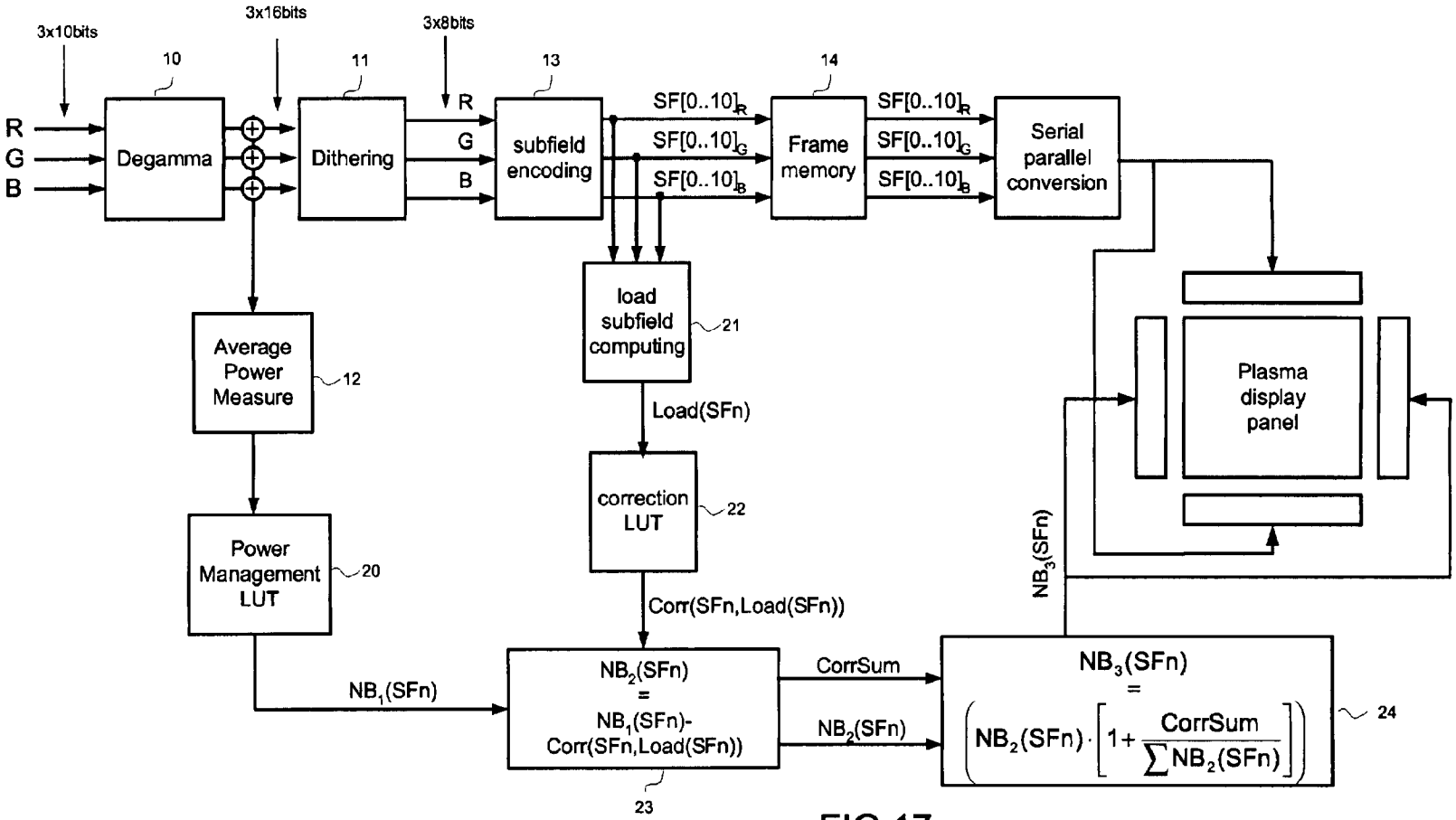

Exemplary embodiments of the invention are illustrated in the drawings and are explained in more detail in the following description, the drawings showing in:

FIG. 1 a diagram representing the peak luminance and the power consumption according to the picture load in a classical plasma display panel;

FIG. 2 a diagram representing the number of sustain pulses for peak white according to the picture load in a classical plasma display panel;

FIG. 3 the time duration of a frame according to picture load in a classical plasma display panel;

FIG. 4 the load effect in a classical plasma display panel when the sustain frequency is high;

FIG. 5 the solarization effect on a natural scene due to load effect;

FIG. 6 a video picture and the associated histogram showing the load per subfield of that picture;

FIG. 7 a diagram showing the line load for each subfield for displaying the video picture of the FIG. 6;

FIG. 8 a computer picture and the associated histogram showing the load per subfield of that picture;

FIG. 9 a diagram showing the line load for each subfield for displaying the video picture of the FIG. 8;

FIG. 10 the computer picture of FIG. 8 wherein the line load effect is shown;

FIG. 11 a curve showing the sustain frequency to be selected for a subfield in accordance with the maximal load difference between two consecutive lines of the panel for the corresponding subfield;

FIG. 12 a block diagram showing the generation of a number of sustain pulses for each subfield adapted to its sustain frequency;

FIG. 13 a curve showing the number of sustain pulses in a frame in accordance with the picture load;

FIG. 14 two curves illustrating the reduction of sustain pulses for peak white due the modification of the sustain frequency;

FIG. 15 a block diagram of a circuit implementation of a plasma display device according to the invention;

FIG. 16 a diagram showing the luminance efficacy according to load;

FIG. 17 a block diagram of a circuit implementation of a plasma display device implementing an adjustment of the sustain pulses of the subfields on the basis of their load ; and FIG. 18 a LUT comprising correction values to be subtracted to the number of sustain pulses of each subfield in order to compensate load effect.

EXEMPLARY EMBODIMENTS

The method of the invention is based on an analysis of the line load of each subfield in order to determine if this subfield is more or less critical to the so-called "line load effect". If such an effect is detected for a subfield, its sustain frequency is reduced to minimize the load effect.

In the presented embodiments, the frame comprises 11 subfields with the following weights:

1-2-3-5-8-12-18-27-41-58-80 ($\Sigma$=255)

In order to better understand the type of picture sequence sensitive to line load effect, two picture sequences are analyzed below. The first one is a video sequence not critical for line load effect and the second one is a computer sequence comprising geometrical patterns that is more critical for line-load effect.

Analysis of a Video Sequence

The video sequence shown on the left side of FIG. 6 represents an "european man face". The global load per subfield for that sequence displayed on a WVGA screen with 852×480×3 cells (or luminous elements) is given by the histogram of the left side of the figure and by the below table. The load of a subfield is the amount (or number) of activated cells of the panel during said subfield. In the below table, the subfield load is expressed as a percentage of the total amount of cells of the panel.

| Subfield | Weigth | Load |
|---|---|---|
| 1 | 1 | 63.24% |
| 2 | 2 | 74.69% |
| 3 | 3 | 73.94% |
| 4 | 5 | 79.73% |
| 5 | 8 | 88.45% |
| 6 | 12 | 77.34% |
| 7 | 18 | 32.67% |
| 8 | 27 | 81.26% |
| 9 | 41 | 12.12% |
| 10 | 58 | 3.94% |
| 11 | 80 | 0.43% |

There is a big difference in the global load of the subfields: the subfield SF7 is less loaded than its neighbors (SF1, SF2, SF3, SF4, SF5, SF6, SF8). This introduces a so-called solarization or quantization effect since the subfield SF7 will be proportionally more luminous than the other ones.

The distribution line by line of the global load of each subfield is represented by the FIG. 7. The horizontal axis represents the lines of the picture (480 lines in WVGA) and the vertical axis represents the number of illuminated pixels (up to 852 in WVGA) per line. A curve is drawn for each subfield.

From this figure, it can be seen that the line loads for the subfields SF0, SF1, SF2, SF3, SF4, SF5 and SF7 are quite stable whereas there are more variations for the other ones. In any case, the maximal difference between two consecutive lines is 105. In that case, the load difference of luminance of one subfield between two consecutive lines is not very high and not a big problem. Therefore, in case of such pictures, the line load effect is not annoying.

Analysis of a Computer Picture (Mode PC) for Monitors

The computer picture shown at the left side of FIG. 8 is a picture of a histogram with some text, notably a title "Analysis of line-load effect" on a dark area at the top of the picture and a comment "Results shows serious issues on picture quality" on a white area at the bottom of the picture. The global load per subfield for that sequence is given by the histogram on the right side of FIG. 8 and by the below table:

| Subfield | Weigth | Load |
|---|---|---|
| 1 | 1 | 54.66% |
| 2 | 2 | 68.72% |
| 3 | 3 | 62.00% |
| 4 | 5 | 59.02% |
| 5 | 8 | 72.33% |
| 6 | 12 | 78.64% |
| 7 | 18 | 58.30% |
| 8 | 27 | 42.17% |
| 9 | 41 | 74.87% |
| 10 | 58 | 77.90% |
| 11 | 80 | 73.58% |

In that sequence, the load of the various subfields is more homogeneous than in the case of the video sequence. The distribution line by line of the global load of each subfield is represented by the FIG. 9 to be compared with FIG. 7. There are strong discontinuities in the line load of each subfield and the maximal line load difference between two consecutive lines is much more high. This maximal line load difference is equal to 590 for subfield SF9 and SF10. It introduces, for these subfields, a big difference of luminance from one line to the next one.

In that sequence, the load effect manifests itself by an enhancement of the luminance of the background behind the dark area of the title as shown on FIG. 10. At the bottom of the picture, it is the opposite. The white area, introduces a reduction of the luminance of the background since the corresponding lines are more loaded.

Sustain Frequency Adjustment

The main idea of the invention is to adjust the sustain frequency of each subfield in accordance with its load. More particularly, the line load difference between two consecutive lines is analyzed for each subfield and the sustain frequency of the subfield is selected in accordance with its maximal line load difference.

Preferably, the lines with a low load for the current subfield are not analyzed. Indeed, it makes no sense to evaluate the influence of the load of a subfield if this subfield is not enough used. Therefore, in the analysis of the difference between two consecutive lines, we limit the analysis to lines that have at least 10% of illuminated cells. This limit is referenced MinLoad.

Then, for each subfield, the line load difference Diff(L,n) between two consecutive lines L and L+1 for a subfield n is computed as following:

$$Diff(L;n) = \begin{cases} |\text{Load}(L+1;n) - \text{Load}(L;n)| & \text{if Load}(L;n) \geq MinLoad \\ 0 & \text{otherwise} \end{cases}$$

where Load(L,n) is the load of the line L for the subfield n. The maximal line load difference for a subfield n, referenced MaxDiff(n), is then calculated: MaxDiff(n)=$MAX_{for\ all\ L}$(Diff(L;n)).

The maximal line load difference of each subfield n for the computer picture of FIG. 8 is given by the below table:

| Subfield n | MaxDiff(n) |
|---|---|
| 0 | 391 |
| 1 | 465 |
| 2 | 462 |
| 3 | 414 |
| 4 | 489 |
| 5 | 567 |
| 6 | 337 |
| 7 | 278 |
| 8 | 575 |
| 9 | 590 |
| 10 | 590 |

The sustain frequence of each subfield n is then adjusted depending on the value MaxDiff(n) as indicated by the curve of FIG. 11. This curve is stored in a Look up table (LUT). The sustain frequency of the subfield n decreases as MaxDiff(n) increases.

Depending on these values, the sustain frequency of the displayed picture is then selected according to a predetermined table. When the maximal load difference is low, the line load effect is low and the sustain frequency can be high (e.g. 250 kHz). At the opposite, when the maximal load difference is high, the line load effect is high and the sustain frequency should be low (e.g. 200 kHz) to minimize it. It has to be noted that the load effect is also higher when the percentage of xenon is important in the gas of the cell.

In the invention, with a judicious choice of the sustain frequency, it is possible to reduce by a factor of two the load effect.

Such an adjustment of the sustain frequency should be made cautiously to avoid any brutal change of the picture luminance when minor changes of the picture are happening. Therefore, it is preferable to reduce the load effect slowly for example by means of a temporal filter.

Consequently, the maximal load difference MaxDiff(n;t) for a subfield n and a frame t is preferably filtered on T preceding frames to deliver a value MaxDiff'(n;t)as following:

$$MaxDiff'(n;t) = \frac{1}{T} \cdot \sum_{k=t-T+1}^{k=t} MaxDiff(n;t).$$

When a new scene is detected, for example by a scene cut detection means, the value MaxDiff(n;t) on T preceding frames and MaxDiff'(n;t) is directly be taken as equal to MaxDiff(n;t).

The method of the invention can be implemented in parallel to a power management method as described previously, by the computation of an average power level for each picture, and used for modifying the total amount of sustain pulses in the frame and consequently for modifying the amount of sustain pulses of each subfield.

The act of optimizing the sustain frequency of each subfield modifies the available time to generate sustain pulses. Indeed, if the sustain frequency of a high weight subfield is reduced, the time to generate all its sustain pulses is longer and it can limit the peak-white value if there is not enough time to generate them. For instance, if the sustain frequency of the most significant subfield (subfield with the highest weight) is reduced from 250 kHz to 200 kHz, then the time required for the sustain pulses of this subfield is increased by 20%.

Therefore, it is necessary to modify the number of sustain pulses of each subfield in accordance with the selected sustain frequencies in order to have enough time to perform all the sustain pulses.

To this end, the operations illustrated by FIG. 12 are carried out:

- the maximal load difference MaxDiff(n;t), or MaxDiff'(n;t) if filtering, is used for selecting an adjustment coefficient Adj(n;t) for adjusting the number of sustain pulses of the subfield n; this coefficient corresponds to the reduced number of sustain pulses that is obtained by reducing the frequency from the maximal frequency (for example 250 kHz) to the selected frequency; for instance, if MaxDiff'(n;t)=640, then the selected sustain frequency is 200 kHz (−20%) and then the coefficient value is 0.8 (20% less time).
- in parallel, an average power level APL(t) is calculated for the picture corresponding to the frame t by summing the video levels of all the pixels of the picture t,
- the coefficient Adj(n;t) is multiplied by the maximal number of sustain pulses for the subfield n, referenced MaxSustainNb(n) in order to obtain a new maximal number of sustain pulses MaxSustainNb'(n). The maximal number of sustain pulses MaxSustainNb(n) corresponds to the number of sustain pulses for a zero picture load (APL=0).
- the new maximal numbers of sustain pulses for all the subfields are summed up to give the total amount of sustain pulses after adjustment, referenced Sum(t):

$$Sum(t) = \sum_{n=0}^{n=11} MaxSustainNb'(n, t).$$

- the value Sum(t) is converted in an average power level APL'(t) by an inverse APL table. This table delivers for each total amount of sustain pulses after adjustment, Sum(t), the nearest APL corresponding to that value of sustain pulses. The values stored in this table follow the inverse of the curve of FIG. 13. For instance, if Sum(t) is equal to 800, APL'(t) is equal to 16%.
- the two values APL(t) and APL'(t) are compared and the maximal value referenced APL"(t) is selected; for instance, if APL(t)=20% and APL'(t)=16%, APL"(t)=20%.
- the value APL"(t) is then converted by an APL table in a number of sustain pulses for each subfield n, referenced SustainNb(n). The values stored in this table follow the curve of FIG. 13. According to this curve, the total amount of sustain pulses in a frame decreases as the picture load APL increases.

FIG. 14 illustrates the case where APL'(t) is greater than APL(t). In that case, the maximal peak white is reduced in order that the sustain duration for generating said reduced amount of sustain pulses be not to longer.

Circuit Implementation

FIG. 15 illustrates a possible circuit implementation of the inventive method. The input picture data $D_{in}$ for the three colors RGB are forwarded to a degamma block 10 where the following operation is applied to the data:

$$D_{out} = 65535 \times \left(\frac{D_{in}}{1023}\right)^{\gamma} \text{ where } \gamma = 2.2.$$

The input data comprise 10 bits in our example whereas the output data comprise 16 bits. The data are then processed by a block 12 for delivering an average power level APL(t) for each frame t with $$APL(t) = \frac{1}{C \times L} \cdot \sum_{x,y} l(x, y)$$

as described previously.

In parallel, the data outputted by the degamma block 10 are processed by a dithering block 11 in order to obtain 8 bits data (24 bits for the 3 colors). The data delivered by the dithering block 13 are then processed by an encoding block 13 that converts them by means of a LUT into subfield data (11 bits data in the present case). The subfield data are then stored in a frame memory 14 and converted into serial data before being displayed by the display panel.

For implementing the method of the invention, the circuit comprises a computation block 15 that processes the data outputted by the dithering block 11. The block 15 computes, for each frame t and for each subfield n, the maximal load difference MaxDiff(n;t) between two consecutive lines of the panel. The value MaxDiff(n;t) is then time filtered by a filter 16 in order to obtain MaxDiff'(n;t). If no scene cut is detected, there is no filtering.

The value MaxDiff'(n;t) is used by a first LUT 17 to deliver a sustain frequency SustainFreq(n) for each subfield n in accordance with said MaxDiff'(n;t) value and as illustrated by FIG. 11. The value SustainFreq(n) is transmitted to the control unit of the display panel.

The value MaxDiff'(n;t) is also used by a LUT 18 for determining an adjustment coefficient Adj(n) for each subfield n as explained before. A multiplier 19 is then used for multiplying this coefficient by the maximal number of sustain pulses MaxSustainNb(n;t) in a frame and the result is the value MaxSustainNb'(n;t).

The maximal numbers of sustain pulses MaxSustainNb'(n;t) of all subfields are summed up in a block 20 as following:

$$Sum(t) = \sum_{n=0}^{n=11} MaxSustainNb'(n, t).$$

Based on this new total amount of sustain pulses Sum(t), an inverse APL table 21 delivers the average power level APL'(t) as explained before. The maximal value between APL(t) and APL'(t) is then selected by a block 22. This value, APL"(t), is then used by an APL table 23 for delivering for each sub-field n the total amount of sustains SustainNb(n) that should be employed by the panel to display the picture t.

According to the invention, the load effect can also be compensated by adjusting the number of sustain pulses of each subfield. A correction value is calculated for each subfield. This value, depending on the load and the number of sustain pulses of the subfield, is subtracted to the number of sustain pulses of the subfield. These method can be combined with the adjustment of the sustain frequency of each subfield in accordance with its maximal load difference. This method can also be used independently.

Preferably, the subtracted sustain pulses are redistributed to the subfields proportionally to their new amount of sustain pulses in order to avoid a loss of luminance (a reduced peak luminance).

Preferably, the adjusting step is implemented after the computation of the picture load, for example by calculating the Average Power Level (APL), and after the rescaling of the number of sustain pulses of each subfield in order to keep constant the power consumption of the display panel.

In a facultative preliminary step, the numbers of sustain pulses of the subfields are rescaled, for example by APL as shown in FIG. 3, in order to keep constant the power consumption. At the end of this step, the maximal peak white can vary from 200 sustain pulses up to 1080 sustain pulses.

This method comprises three main steps:

a subfield load computation step;

an step of adjusting the number of sustain pulses per subfield according to subfield load; and preferably, a step of redistribution of the subtracted sustain pulses.

For a peak white value with 1080 sustain pulses, the number of sustain pulses of the highest weight subfield is 80/255*1080=339. So, in order to determine the attenuation of all subfields due to load effect, it is necessary to measure the panel luminance behavior from a minimum of 1 sustain pulse up to a maximum of 340 sustain pulses. Obviously, not all values have to be measured but rather a subset of values. The other values are calculated by interpolation since load effect is more or less a proportional effect.

The measurement is for example carried out on a square area of the screen. The picture load is made evolving from, for example, 8.5% up to 100%. The gray levels in this area are coded with only one subfield having successively all sustain pulses numbers of the subset. An example of measurement results is presented on the table below for only some measuring points (from 1 sustain pulse to 130 sustain pulses with load varying from 8.5% to 100%). The luminance behavior results are expressed in candela per square meter (cd/m$^2$). The load is given vertically in the left column of the table and the number of sustain pulses is given horizontally in the top row of the table. This table comprises a reduced amount of values to simplify the exposition of the invention.

| | | Sustain pulses number | | | | | | | | | | | | | | | | |
|---|---|---|---|---|---|---|---|---|---|---|---|---|---|---|---|---|---|---|
| | | 1 | 2 | 4 | 8 | 10 | 20 | 30 | 40 | 50 | 60 | 70 | 80 | 90 | 100 | 110 | 120 | 130 |
| Load (%) | 8.50% | 1.20 | 2.37 | 4.66 | 9.19 | 11.31 | 22.29 | 32.92 | 43.20 | 53.15 | 62.75 | 72.01 | 80.93 | 89.50 | 97.73 | 105.62 | 113.17 | 120.37 |
| | 12.00% | 1.19 | 2.33 | 4.58 | 9.02 | 11.10 | 21.81 | 32.25 | 42.34 | 52.06 | 61.64 | 70.49 | 79.36 | 87.65 | 95.68 | 103.72 | 110.81 | 118.37 |
| | 14.50% | 1.18 | 2.31 | 4.52 | 8.88 | 10.92 | 21.49 | 31.71 | 41.65 | 51.24 | 60.49 | 69.49 | 77.90 | 86.18 | 94.40 | 101.86 | 108.25 | 116.03 |
| | 17.00% | 1.18 | 2.28 | 4.47 | 8.76 | 10.79 | 21.16 | 31.28 | 41.11 | 50.53 | 59.48 | 68.38 | 76.89 | 85.00 | 92.78 | 100.27 | 107.46 | 114.11 |
| | 19.50% | 1.17 | 2.26 | 4.41 | 8.64 | 10.62 | 20.84 | 30.78 | 40.49 | 49.76 | 58.68 | 67.30 | 75.63 | 83.65 | 91.33 | 98.97 | 105.84 | 112.59 |
| | 21.00% | 1.16 | 2.25 | 4.38 | 8.56 | 10.52 | 20.66 | 30.55 | 40.10 | 49.35 | 58.09 | 66.78 | 75.01 | 82.89 | 90.55 | 97.90 | 104.98 | 111.40 |
| | 23.00% | 1.15 | 2.23 | 4.34 | 8.49 | 10.42 | 20.41 | 30.16 | 39.74 | 48.77 | 57.48 | 65.98 | 74.10 | 82.01 | 89.47 | 96.94 | 103.71 | 110.28 |
| | 24.50% | 1.14 | 2.22 | 4.31 | 8.41 | 10.33 | 20.26 | 29.89 | 39.34 | 48.40 | 56.92 | 65.47 | 73.55 | 81.25 | 88.79 | 95.97 | 102.76 | 109.19 |
| | 26.00% | 1.13 | 2.20 | 4.28 | 8.33 | 10.24 | 20.05 | 29.65 | 38.99 | 47.95 | 56.49 | 64.80 | 72.77 | 80.30 | 87.89 | 95.08 | 101.94 | 107.49 |
| | 27.00% | 1.12 | 2.19 | 4.25 | 8.29 | 10.18 | 19.93 | 29.45 | 38.79 | 47.69 | 56.11 | 64.43 | 72.32 | 80.13 | 87.46 | 94.59 | 101.28 | 107.59 |
| | 29.00% | 1.11 | 2.15 | 4.20 | 8.21 | 10.08 | 19.75 | 29.12 | 38.36 | 47.12 | 55.47 | 63.79 | 71.63 | 79.24 | 86.46 | 93.51 | 100.31 | 106.34 |
| | 30.00% | 1.10 | 2.13 | 4.17 | 8.15 | 10.01 | 19.59 | 28.96 | 38.15 | 46.79 | 55.15 | 63.32 | 71.07 | 78.66 | 85.89 | 92.98 | 99.53 | 105.77 |
| | 31.00% | 1.09 | 2.11 | 4.13 | 8.10 | 9.95 | 19.47 | 28.77 | 37.90 | 46.51 | 54.80 | 62.91 | 70.69 | 78.18 | 85.39 | 92.37 | 98.93 | 105.07 |
| | 32.50% | 1.09 | 2.09 | 4.09 | 8.02 | 9.87 | 19.32 | 28.56 | 37.58 | 46.00 | 54.39 | 62.40 | 70.06 | 77.64 | 84.63 | 91.56 | 98.18 | 104.38 |
| | 33.50% | 1.09 | 2.08 | 4.05 | 7.92 | 9.79 | 19.19 | 28.35 | 37.29 | 45.68 | 53.98 | 61.91 | 69.61 | 76.70 | 84.17 | 91.05 | 97.48 | 103.52 |
| | 34.50% | 1.08 | 2.07 | 4.04 | 7.91 | 9.74 | 19.09 | 28.22 | 37.05 | 45.49 | 53.64 | 61.60 | 69.27 | 76.58 | 83.65 | 90.51 | 97.00 | 102.88 |
| | 39.00% | 1.07 | 2.04 | 3.95 | 7.73 | 9.47 | 18.58 | 27.50 | 36.13 | 44.28 | 52.33 | 59.92 | 67.55 | 74.56 | 81.49 | 88.14 | 94.54 | 100.49 |
| | 42.50% | 1.05 | 2.02 | 3.89 | 7.56 | 9.28 | 18.18 | 26.89 | 35.33 | 43.38 | 51.14 | 58.83 | 66.05 | 73.15 | 80.00 | 86.52 | 92.49 | 98.15 |
| | 46.00% | 1.03 | 2.00 | 3.83 | 7.42 | 9.12 | 17.81 | 26.42 | 34.62 | 42.51 | 50.20 | 57.54 | 64.66 | 71.60 | 78.25 | 84.62 | 90.61 | 96.14 |
| | 49.00% | 1.01 | 1.98 | 3.78 | 7.31 | 8.96 | 17.55 | 25.92 | 34.08 | 41.96 | 49.30 | 56.58 | 63.56 | 70.38 | 76.87 | 83.37 | 89.09 | 94.65 |
| | 52.00% | 0.99 | 1.95 | 3.74 | 7.20 | 8.84 | 17.20 | 25.50 | 33.47 | 41.25 | 48.50 | 55.69 | 62.72 | 69.10 | 75.63 | 81.93 | 87.81 | 93.03 |
| | 55.00% | 0.98 | 1.91 | 3.68 | 7.11 | 8.70 | 16.99 | 25.09 | 33.09 | 40.62 | 47.86 | 54.81 | 61.64 | 68.31 | 74.41 | 80.56 | 86.38 | 91.76 |
| | 58.00% | 0.97 | 1.87 | 3.62 | 7.01 | 8.57 | 16.72 | 24.75 | 32.61 | 40.03 | 47.05 | 54.10 | 60.67 | 67.18 | 73.41 | 79.30 | 85.01 | 90.22 |
| | 60.50% | 0.96 | 1.84 | 3.57 | 6.93 | 8.49 | 16.52 | 24.44 | 32.26 | 39.60 | 46.56 | 53.42 | 59.95 | 66.36 | 72.44 | 78.35 | 83.97 | 89.12 |
| | 63.00% | 0.96 | 1.82 | 3.52 | 6.86 | 8.41 | 16.37 | 24.12 | 31.91 | 39.12 | 45.89 | 52.74 | 59.41 | 65.64 | 71.75 | 77.63 | 83.21 | 88.15 |
| | 65.50% | 0.95 | 1.81 | 3.48 | 6.80 | 8.33 | 16.21 | 23.95 | 31.64 | 38.73 | 45.55 | 52.35 | 58.79 | 65.01 | 71.01 | 76.85 | 82.39 | 87.38 |
| | 67.50% | 0.95 | 1.80 | 3.46 | 6.74 | 8.27 | 16.10 | 23.79 | 31.40 | 38.39 | 45.26 | 52.00 | 58.38 | 64.62 | 70.50 | 76.31 | 81.78 | 86.78 |
| | 70.00% | 0.94 | 1.80 | 3.43 | 6.68 | 8.20 | 15.98 | 23.64 | 31.12 | 38.10 | 44.90 | 51.55 | 57.95 | 64.11 | 70.07 | 75.74 | 81.15 | 86.09 |
| | 78.50% | 0.93 | 1.77 | 3.36 | 6.50 | 8.01 | 15.67 | 23.13 | 30.44 | 37.17 | 43.95 | 50.26 | 56.59 | 62.61 | 68.44 | 74.21 | 79.29 | 84.08 |
| | 86.00% | 0.93 | 1.75 | 3.32 | 6.37 | 7.82 | 15.29 | 22.61 | 29.70 | 36.44 | 42.89 | 49.18 | 55.52 | 61.23 | 67.21 | 72.56 | 77.81 | 82.26 |
| | 92.50% | 0.92 | 1.74 | 3.28 | 6.29 | 7.69 | 14.97 | 22.17 | 29.22 | 35.85 | 42.07 | 48.46 | 54.45 | 60.27 | 65.77 | 71.18 | 76.28 | 80.97 |
| | 100% | 0.91 | 1.73 | 3.24 | 6.19 | 7.58 | 14.75 | 21.79 | 28.76 | 35.28 | 41.48 | 47.64 | 53.52 | 59.21 | 64.61 | 69.95 | 74.98 | 79.59 |

Subfield Load Computation

This step consists in counting the luminous elements that are to be illuminated during each subfield for the picture to be displayed.

This step can be easily implemented by using, for each subfield, a counter counting the subfield data corresponding to luminous elements "ON".

Adjusting Step of Sustain Pulses

This step leads in the definition of a number of sustain pulses for each subfield minimizing the load effect.

Based on this measurement step, the luminance efficacy can be computed for each number of sustain pulses and load to provide the efficacy of each subfield compared with the luminance for the lowest non-zero load (8,5% in the present case). The efficacy results are given in the table below the values of load and sustain pulses number of the previous table. In this table, the efficacy of 100% is allocated to the values obtained for a load of 8.5%.

| | | Sustain pulses number | | | | | | | | | |
|---|---|---|---|---|---|---|---|---|---|---|---|
| | | 1 | 2 | 4 | 8 | 10 | 20 | 30 | 40 | 50 | 60 |
| Load (%) | 8.50% | 100 | 100 | 100 | 100 | 100 | 100 | 100 | 100 | 100 | 100 |
| | 12.00% | 99.24 | 98.58 | 98.24 | 98.15 | 98.11 | 97.88 | 97.98 | 98.00 | 97.96 | 98.24 |
| | 14.50% | 98.67 | 97.45 | 96.93 | 96.65 | 96.54 | 96.43 | 96.34 | 96.41 | 96.40 | 96.40 |
| | 17.00% | 98.10 | 96.46 | 95.79 | 95.30 | 95.35 | 94.95 | 95.04 | 95.16 | 95.07 | 94.80 |
| | 19.50% | 97.33 | 95.61 | 94.56 | 94.05 | 93.86 | 93.50 | 93.52 | 93.71 | 93.62 | 93.52 |
| | 21.00% | 96.95 | 95.04 | 93.94 | 93.20 | 93.00 | 92.69 | 92.82 | 92.83 | 92.85 | 92.57 |
| | 23.00% | 96.19 | 94.19 | 92.98 | 92.35 | 92.05 | 91.58 | 91.63 | 91.97 | 91.77 | 91.60 |
| | 24.50% | 95.24 | 93.77 | 92.36 | 91.50 | 91.27 | 90.89 | 90.80 | 91.05 | 91.07 | 90.71 |
| | 26.00% | 94.10 | 93.06 | 91.75 | 90.70 | 90.53 | 89.97 | 90.08 | 90.24 | 90.21 | 90.02 |
| | 27.00% | 93.33 | 92.63 | 91.22 | 90.25 | 89.99 | 89.44 | 89.48 | 89.79 | 89.73 | 89.41 |
| | 29.00% | 92.19 | 91.08 | 90.08 | 89.30 | 89.13 | 88.61 | 88.46 | 88.79 | 88.66 | 88.40 |
| | 30.00% | 91.62 | 90.23 | 89.46 | 88.70 | 88.51 | 87.91 | 87.97 | 88.31 | 88.03 | 87.89 |
| | 31.00% | 91.24 | 89.38 | 88.67 | 88.20 | 87.97 | 87.36 | 87.40 | 87.72 | 87.51 | 87.33 |
| | 32.50% | 90.86 | 88.53 | 87.80 | 87.30 | 87.19 | 86.67 | 86.76 | 86.98 | 86.55 | 86.68 |
| | 33.50% | 90.48 | 88.10 | 86.92 | 86.20 | 86.53 | 86.09 | 86.12 | 86.32 | 85.95 | 86.03 |
| | 34.50% | 90.29 | 87.68 | 86.57 | 86.10 | 86.04 | 85.65 | 85.74 | 85.76 | 85.58 | 85.48 |
| | 39.00% | 89.14 | 86.26 | 84.64 | 84.10 | 83.69 | 83.36 | 83.56 | 83.62 | 83.32 | 83.40 |
| | 42.50% | 87.81 | 85.41 | 83.41 | 82.25 | 82.00 | 81.59 | 81.70 | 81.77 | 81.62 | 81.49 |
| | 46.00% | 85.71 | 84.42 | 82.09 | 80.70 | 80.60 | 79.91 | 80.26 | 80.14 | 79.99 | 80.00 |
| | 49.00% | 83.81 | 83.57 | 81.04 | 79.50 | 79.16 | 78.76 | 78.74 | 78.88 | 78.95 | 78.56 |
| | 52.00% | 82.48 | 82.29 | 80.16 | 78.35 | 78.13 | 77.19 | 77.45 | 77.48 | 77.61 | 77.28 |
| | 55.00% | 81.52 | 80.59 | 79.02 | 77.35 | 76.89 | 76.24 | 76.21 | 76.59 | 76.43 | 76.27 |
| | 58.00% | 80.57 | 79.18 | 77.70 | 76.25 | 75.78 | 75.03 | 75.20 | 75.48 | 75.32 | 74.97 |
| | 60.50% | 80.00 | 77.90 | 76.56 | 75.45 | 75.00 | 74.14 | 74.25 | 74.67 | 74.50 | 74.21 |
| | 63.00% | 79.62 | 77.05 | 75.42 | 74.70 | 74.34 | 73.47 | 73.28 | 73.85 | 73.61 | 73.13 |
| | 65.50% | 79.24 | 76.63 | 74.63 | 74.00 | 73.60 | 72.72 | 72.76 | 73.22 | 72.87 | 72.59 |
| | 67.50% | 78.86 | 76.20 | 74.10 | 73.35 | 73.11 | 72.22 | 72.28 | 72.67 | 72.24 | 72.12 |
| | 70.00% | 78.67 | 75.92 | 73.49 | 72.65 | 72.49 | 71.69 | 71.82 | 72.04 | 71.68 | 71.55 |
| | 78.50% | 77.90 | 74.79 | 72.08 | 70.75 | 70.76 | 70.30 | 70.27 | 70.45 | 69.94 | 70.03 |
| | 86.00% | 77.14 | 74.08 | 71.20 | 69.35 | 69.15 | 68.60 | 68.68 | 68.75 | 68.57 | 68.35 |
| | 92.50% | 76.57 | 73.51 | 70.32 | 68.40 | 68.00 | 67.17 | 67.36 | 67.64 | 67.46 | 67.04 |
| | 100% | 76.00 | 72.95 | 69.53 | 67.40 | 66.97 | 66.18 | 66.20 | 66.57 | 66.38 | 66.11 |

| | | Sustain pulses number | | | | | | | |
|---|---|---|---|---|---|---|---|---|---|
| | | 70 | 80 | 90 | 100 | 110 | 120 | 130 | Mean |
| Load (%) | 8.50% | 100 | 100 | 100 | 100 | 100 | 100 | 100 | 100% |
| | 12.00% | 97.89 | 98.07 | 97.94 | 97.90 | 98.20 | 97.92 | 98.34 | 98.01% |
| | 14.50% | 96.50 | 96.26 | 96.29 | 96.59 | 96.44 | 95.66 | 96.40 | 96.36% |
| | 17.00% | 94.96 | 95.01 | 94.98 | 94.93 | 94.94 | 94.96 | 94.81 | 95.01% |
| | 19.50% | 93.47 | 93.45 | 93.46 | 93.45 | 93.70 | 93.53 | 93.54 | 93.57% |
| | 21.00% | 92.73 | 92.69 | 92.62 | 92.66 | 92.69 | 92.76 | 92.55 | 92.74% |
| | 23.00% | 91.62 | 91.57 | 91.63 | 91.55 | 91.78 | 91.64 | 91.62 | 91.70% |
| | 24.50% | 90.92 | 90.88 | 90.78 | 90.85 | 90.86 | 90.80 | 90.71 | 90.91% |
| | 26.00% | 89.99 | 89.92 | 89.73 | 89.93 | 90.02 | 90.08 | 89.30 | 90.06% |
| | 27.00% | 89.48 | 89.37 | 89.53 | 89.49 | 89.56 | 89.50 | 89.38 | 89.56% |
| | 29.00% | 88.58 | 88.51 | 88.54 | 88.46 | 88.53 | 88.64 | 88.34 | 88.61% |
| | 30.00% | 87.93 | 87.83 | 87.89 | 87.88 | 88.03 | 87.95 | 87.87 | 88.01% |
| | 31.00% | 87.36 | 87.36 | 87.35 | 87.38 | 87.45 | 87.42 | 87.29 | 87.47% |
| | 32.50% | 86.66 | 86.58 | 86.75 | 86.60 | 86.69 | 86.76 | 86.72 | 86.74% |
| | 33.50% | 85.98 | 86.02 | 85.69 | 86.13 | 86.20 | 86.14 | 86.01 | 86.10% |
| | 34.50% | 85.55 | 85.60 | 85.56 | 85.59 | 85.69 | 85.71 | 85.47 | 85.66% |
| | 39.00% | 83.22 | 83.47 | 83.30 | 83.38 | 83.45 | 83.54 | 83.49 | 83.44% |
| | 42.50% | 81.70 | 81.62 | 81.73 | 81.85 | 81.92 | 81.73 | 81.54 | 81.73% |
| | 46.00% | 79.91 | 79.90 | 80.00 | 80.06 | 80.11 | 80.06 | 79.87 | 80.08% |
| | 49.00% | 78.58 | 78.55 | 78.64 | 78.65 | 78.93 | 78.72 | 78.64 | 78.76% |
| | 52.00% | 77.33 | 77.51 | 77.21 | 77.38 | 77.57 | 77.60 | 77.29 | 77.48% |
| | 55.00% | 76.11 | 76.17 | 76.33 | 76.13 | 76.27 | 76.33 | 76.23 | 76.33% |
| | 58.00% | 75.14 | 74.97 | 75.06 | 75.11 | 75.08 | 75.12 | 74.95 | 75.19% |
| | 60.50% | 74.19 | 74.08 | 74.15 | 74.12 | 74.18 | 74.20 | 74.04 | 74.31% |
| | 63.00% | 73.24 | 73.41 | 73.34 | 73.42 | 73.50 | 73.53 | 73.23 | 73.51% |
| | 65.50% | 72.70 | 72.65 | 72.64 | 72.66 | 72.76 | 72.80 | 72.60 | 72.83% |
| | 67.50% | 72.21 | 72.14 | 72.20 | 72.14 | 72.25 | 72.26 | 72.09 | 72.32% |
| | 70.00% | 71.58 | 71.61 | 71.63 | 71.70 | 71.71 | 71.71 | 71.53 | 71.77% |
| | 78.50% | 69.79 | 69.93 | 69.96 | 70.02 | 70.26 | 70.06 | 69.85 | 70.15% |
| | 86.00% | 68.30 | 68.60 | 68.41 | 68.77 | 68.70 | 68.76 | 68.34 | 68.64% |
| | 92.50% | 67.30 | 67.28 | 67.34 | 67.29 | 67.39 | 67.40 | 67.27 | 67.39% |
| | 100% | 66.16 | 66.13 | 66.15 | 66.11 | 66.22 | 66.25 | 66.12 | 66.29% |

A luminance attenuation representative of the load effect can be deduced from these efficacy values for each subfield:

$$\text{Attenuation}=100\%-\text{efficacy}$$

The previous table shows that, in fact, the load effect is quite independent from the number of sustain pulses. Indeed, if we except the values obtained for the very low sustain pulses number where a lot of measuring failures could be done (because luminance is too low), it can be seen that globally the attenuation for a given picture load is quite stable. The efficacy can be approximated to the mean value (without taking into account the first values) for each. The left column of the table gives this mean value for each load. FIG. 16 shows a curve illustrating the mean value of efficacy versus load. As it can be seen on this curve, the evolution of the efficacy versus the load is quite monotonous and smooth. It is a reason why it is possible to calculate an attenuation value (representative of load effect) for some load values by interpolation of measuring points. This curve is used to compute a correction value for each subfield.

The minimal efficacy (66.29%) is obtained for a load of 100%. It corresponds to a luminance attenuation of 33.71%.

In order to have an homogeneous luminance behavior of the subfield independently of the load, the invention proposes to adjust the number of sustain pulses per subfield to get an efficacy of 66.29% for each subfield. For example, for a subfield that should have 107 sustain pulses after rescaling by APL:

- If the load is 100%, there is nothing to do and the 107 sustain pulses of current subfield are kept. In that case, 107 sustain pulses are as luminous as a subfield with 107×0.6629=71 sustain pulses with no luminance attenuation;
- If the load is only 70%, the efficacy is 71,77%. For achieving the same luminance than for a 100% load, it is necessary to apply a correction of x sustain pulses verifying the following equation: (107−x)×0.7177=71. In that case, x=8. The correction consists in subtracting 8 sustain pulses to the theoretical number of sustain pulses of the subfield.
- If the load is 30%, the efficacy is 88.01%. For achieving the same luminance than for a 100% load, it is necessary to apply a correction of x sustain pulses verifying the following equation: (107−x)×0.8801=71. In that case, x=26. The correction consists in subtracting 26 sustain pulses to the theoretical number of sustain pulses of the subfield.
- If the load is 17%, the efficacy is 95.01%. For achieving the same luminance than for a 100% load, it is necessary to apply a correction of x sustain pulses verifying the following equation: (107−x)×0.9501=71. In that case, x=32. The correction consists in subtracting 32 sustain pulses to the theoretical number of sustain pulses of the subfield.

This adjustment step for a subfield SFn can be illustrated by the following equation:

$$NB_2[SFn]=NB_1(SFn)-\text{Corr}[SFn,\text{Load}(SFn)]$$

where

- $NB_1$(SFn) is the number of sustain pulses of the subfield SFn before adjustment,
- $NB_2$(SFn) is the number of sustain pulses of the subfield SFn after adjustment, and
- Corr[SFn,Load(SFn)] is the correction value calculated for the subfield SFn whose charge is Load(SFn).

In a variant, as the luminance attenuation does not vary much with the number of sustain pulses, it is possible, for achieving the correction values, to measure the luminance produced by a plurality of luminous elements of the display panel for only a specific number of sustain pulses and for all the precited loads. A value of the luminance attenuation compared with a reference luminance measured for the highest one of said loads is then determined for each one of said loads. A correction value can be then computed, for each one of said loads and for said specific first number of sustain pulses, by multiplying the determined luminance attenuation with said specific first number of sustain pulses.

Redistribution of the Subtracted Sustain Pulses

In the preceding step, the subfields are corrected to deliver a maximum of 66.29% of luminance. Consequently, the maximal peak luminance of the display is reduced.

According the invention, it is proposed to rescale the number of sustain pulses of each subfield by redistributing in each subfield an amount of the sustain pulses that have been removed during the preceding step proportionally to its new number of sustain pulses.

To this end, the correction values of all subfields are summed up by a counter. This sum is called CorrSum:

$$CorrSum=\sum_{n=0}^{n=10} Corr[SFn;\ Load(SFn)]$$

The redistribution of the subtracted sustain pulses can be illustrated by the following equation:

$$NB_3(SFn)=NB_2(SFn)+NB_2(SFn)\times\frac{CorrSum}{\sum_{n=0}^{n=10} NB_2(SFn)}$$

where $NB_3$(SFn) is the number of sustain pulses of the subfield SFn after redistribution of the subtracted sustain pulses.

Circuit Implementation

FIG. 17 illustrates a possible circuit implementation of the method previously described. The input picture data RGB are forwarded to a degamma block 10 where the following operation is applied $$D_{OUT}=65535\times\left(\frac{D_{IN}}{1023}\right)^{\gamma}$$

where $D_{IN}$ are the input data, $D_{OUT}$ are the output data, and $\gamma$=2.2.

The input data comprise 10 bits in our example whereas the output data have 16 bits. The output data are summed up by an Average Power Measure Block 12 to deliver an Average Power Level (APL) as described previously. A first number of sustain pulses $NB_1$(SFn) is determining for each subfield SFn by a Power management LUT 20 receiving the APL value in order that the average power needed by the PDP for displaying the picture be approximately equal to a predetermined target value.

The output data from the degamma block 10 are in parallel processed by a dithering block 11 to come back to a 8 bits resolution The data outputted by the dithering block 11 are coded in subfield data by an encoding block 13. The subfield data are then stored in a frame memory 14. The amount of active pixel Load(SFn) for each subfield SFn is computed by a load subfield block 21.

Based on Load(SFn) and $NB_1$(SFn), a correction LUT 22 defines the correction value Corr(SFn,Load(SFn)) to be subtracted to the number of sustain pulses $NB_1$(SFn). Another block 23 is used to achieve the following operation $NB_1$(SFn)-Corr(SFn,Load(SFn)). The new number of sustain pulses of the subfield SFn is referenced $NB_2$(SFn).

A block 24 is then used for redistributing the subtracted sustain pulses in all the subfields proportionally to their number of sustain pulses $NB_2$(SFn) and achieves the following operation:

$$NB_3(SFn) = \left(NB_2(SFn) \cdot \left[1 + \frac{CorrSum}{\sum NB_2(SFn)}\right]\right)$$

The numbers of sustain pulses are computed and used to control the PDP to display the subfield data stored in the frame memory 14 and converted in series.

The load effect compensation concept of the present invention is based on a LUT 22 having two inputs: the number of sustain pulses and the subfield load. It delivers the amount of sustain pulses that should be subtracted to the number of sustain pulses to obtain the same luminance than a full loaded subfield. Such a LUT is illustrated by FIG. 18.

In the previously described example, the number of sustain pulses is going from 1 to 339. The table comprises 339 horizontal inputs. For achieving a precision of 6 bits for the load effect, the subfield load should be expressed with 6 bits. The table comprises 64 vertical inputs. The maximal correction that should be applied is linked to the value 339 that should be adjusted to an attenuation of 33,71% (in this case, 114 sustain pulses should be subtracted). This means that a precision of 7 bits is needed for the correction. In that case, the overall memory requirements will be around 339×64×7bits=148 kbits.

For each number of sustain pulses contained by the current subfield (1 to 339) and for each load of this subfield (measured with a step of 1.5%), the LUT 22 provides the exact amount of sustain pulses that should be subtracted from the original amount of sustain pulses.

The utilization of this table requires to compute, for each subfield, its global load (the number of activated luminous elements divided by the total amount of luminous elements). To this end, the load subfield block 21 comprises 11 counters (preferably, 16 counters are planned to cover up to 16 subfield modes), one for each bit of the subfield data and each of them being reset at each frame on the V sync pulse. Then, for each pixel, the appropriate subfield counter is incremented by the corresponding bit of the subfield data. Each counter is incremented by the value of the bit of the subfield data (0 if the subfield is not activated for the current video value and 1 if activated). If the three colors are handled serially (one color at a time with the same encoder), 11 counters are sufficient. Otherwise, if the three colors are encoded in parallel with three LUTs, we will have 33 counters. The size of the counters depends on the maximal amount of analyzed luminous elements: a WXGA panel comprises 1365×768×3=3144960 luminous elements which means a 22 bits counter ($2^{22}$=4194304). The outputs of the counters are limited to 7 bits since a precision of 7 bits for the subfield load computation is sufficient.

In order to improve the working of the circuit, it is possible to add a hysteresis function on the output value of the load subfield block 21 in order to avoid any jitter or oscillation. This corresponds to a kind of filtering of the value of the subfield load.

As this solution is based on a LUT and is fully independent to the subfield structure used, the hardware implementation is very reduced.

The invention claimed is:

1. Method for processing data of a picture to be displayed on a display panel with persistent luminous elements during a frame comprising a plurality of subfields, each subfield comprising an addressing phase during which the luminous elements of the panel are activated or not in accordance with the picture data and a sustain phase during which the activated luminous elements are illuminated by sustain pulses, wherein it comprises the following steps:

computing, for each subfield, the amount of activated luminous elements in each line of luminous elements of the display panel, called line load, calculating, for each subfield, for a current frame and a plurality of frames preceding said current frame, the maximal line load difference between two consecutive lines of the display panel, and selecting, for each subfield, a sustain frequency reduced in accordance with its maximal load difference in order to reduce line load effect.

2. Method according to claim 1, wherein the calculation of the maximal load difference is only carried out for lines whose load is greater than a minimal load.

3. Method according to claim 2, wherein the minimal load for a line is equal to 10% of the amount of luminous elements in a line of the display panel.

4. Method according to claim 1, wherein the maximal load difference, which is used for selecting the sustain frequency, is the mean value of maximal load differences calculated for said plurality of frames of a line.

5. Method according to claim 1, wherein for adjusting the number of sustain pulses of each subfield in accordance with the number of luminous elements to be activated for displaying the current picture and with the selected sustain frequency for said subfield, it comprises the following steps:

measuring a first average power level representative of the number of luminous elements to be activated for displaying the current picture, calculating, for each subfield, an adjustment coefficient corresponding to the ratio between the selected sustain frequency and a standard sustain frequency, calculating a total amount of sustain pulses in a frame, said total amount corresponding to the sum of elementary amounts of sustain pulses, each elementary amount of sustain pulses being relative to a subfield and being the product of a maximal amount of sustain pulses for said subfield with the adjustment coefficient of said subfield, computing a second average power level representative of said total amount of sustain pulses in a frame, and selecting, for each subfield, a number of sustain pulses being reduced in accordance with the maximal value of said first and second average power levels.

6. Method according to claim 1, wherein it further comprises the following steps:

encoding the picture data into subfield data, calculating the load of each subfield on the basis of said subfield data, and adjusting the number of sustain pulses of the subfields on the basis of their loads in order to have a same relation of proportionality between the luminance produced by the persistent luminous elements for the subfields and their weights and for adjusting the number of sustain pulses of a subfield, it comprises the following steps:

providing a first number of sustain pulses for said subfield, defining a correction value to be subtracted to said first number of sustain pulses on the basis of the load and the first number of sustain pulses of said subfield;

subtracting said correction value from said first number of sustain pulses in order to have a second number of sustain pulses for said subfield and wherein the second numbers of sustain pulses of the plurality of subfields are rescaled in order to redistribute in each subfield an amount of the subtracted sustain pulses proportionally to its second number of sustain pulses.

7. Method according to claim 1, wherein it further comprises the following steps:

encoding the picture data into subfield data, calculating the load of each subfield on the basis of said subfield data, and adjusting the number of sustain pulses of the subfields on the basis of their loads in order to have a same relation of proportionality between the luminance produced by the persistent luminous elements for the subfields and their weights and wherein before the step of adjusting the number of sustain pulses of each subfield on the basis of its load, said number of sustain pulses is rescaled in order that the average power level needed by the display means for displaying the picture be approximately equal to a fixed target value.

8. Device for processing data of a picture to be displayed on a display panel with persistent luminous elements during a frame comprising a plurality of subfields, each subfield comprising an addressing phase during which the luminous elements of the panel are activated or not in accordance with the picture data and a sustain phase during which the activated luminous elements are illuminated by sustain pulses, wherein it comprises:

means for computing, for each subfield, the amount of activated luminous elements in each line of luminous elements of the display panel, called line load, and for calculating, for each subfield, for a current frame and a plurality of frames preceding said current frame, the maximal difference of line loads of two consecutive lines of the display panel, and means for selecting, for each subfield, a lower sustain frequency being reduced in accordance with its maximal load difference in order to reduce line load effect.

9. Device according to claim 8, wherein the calculation of the maximal load difference is only carried out for lines whose load is greater than a minimal load.

10. Device according to claim 8, wherein it comprises further a time filter for calculating, for each subfield, a mean value of maximal line load differences for the current frame and a plurality of frames preceding said current frame between two consecutive lines and selecting means for selecting a lower sustain frequency according to said mean value of maximal line load differences.

11. Device according to claim 8, wherein it comprises:

a calculation means for calculating a first average power level representative of the power needed by the display panel for displaying the current picture with a reference sustain frequency, a first look up table for delivering, for each subfield, an adjustment coefficient in accordance with the corresponding maximal difference of line loads, said adjustment coefficient corresponding to the ratio between the selected sustain frequency for said subfield and a standard sustain frequency, a multiplier for multiplying, for each subfield, said adjustment coefficient with a maximal amount of sustain pulses and delivering an adjusted maximal amount of sustain pulses for each subfield, an adder for summing the adjusted maximal amount of sustain pulses of all subfields of the frame, a second look up table for converting said sum of adjusted maximal amount of sustain pulses into a second average power level, a means for selecting the maximal level between the first and second average power levels, and a third look up table for converting said maximal level into an amount of sustain pulses for each subfield.

12. Device according to claim 8, wherein it comprises:

means for encoding the picture data into subfield data, means for calculating the load of each subfield on the basis of said subfield data, and means for adjusting the number of sustain pulses of the subfields on the basis of their load in order to have a same relation of proportionality between the luminance produced by the persistent luminous elements for the subfields and their weights and the means for adjusting the number of sustain pulses of a subfield comprises means for providing a first number of sustain pulses for said subfield, correction means for defining a correction value to be subtracted to said first number of sustain pulses on the basis of the load and the number of sustain pulses of said subfield; and means for subtracting said correction value from said first number of sustain pulses in order to have a second number of sustain pulses for said subfield and comprises means for rescaling the second numbers of sustain pulses of the plurality of subfields in order to redistribute in each subfield an amount of the subtracted sustain pulses proportionally to its second number of sustain pulses.

13. Device according to claim 8, wherein it comprises:

means for encoding the picture data into subfield data, means for calculating the load of each subfield on the basis of said subfield data, and means for adjusting the number of sustain pulses of the subfields on the basis of their load in order to have a same relation of proportionality between the luminance produced by the persistent luminous elements for the subfields and their weights and comprises means for rescaling, before adjusting the number of sustain pulses of each subfield on the basis of its load, said number of sustain pulses in order that the average power level needed by the display means for displaying the picture be approximately equal to a fixed target value.

* * * * *